US009132649B2

(12) United States Patent
Petersen et al.

(10) Patent No.: US 9,132,649 B2
(45) Date of Patent: Sep. 15, 2015

(54) REMOVABLE GUIDE ELEMENT

(75) Inventors: Daniel W Petersen, Philomath, OR (US); Ralph L Stathem, Lebanon, OR (US); Raymond Ehlers, Corvallis, OR (US); Eduardo Martin Orue, Sabadell BCN (ES); Arturo Garcia Gómez, Sabadell Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/394,442

(22) PCT Filed: Apr. 27, 2012

(86) PCT No.: PCT/US2012/035443

§ 371 (c)(1),
(2), (4) Date: Oct. 14, 2014

(87) PCT Pub. No.: WO2013/162595

PCT Pub. Date: Oct. 31, 2013

(65) Prior Publication Data

US 2015/0062262 A1 Mar. 5, 2015

(51) Int. Cl.
*B41J 2/14* (2006.01)
*B41J 2/175* (2006.01)

(52) U.S. Cl.
CPC ..... *B41J 2/1752* (2013.01); *B41J 2/17509* (2013.01); *B41J 2/17556* (2013.01)

(58) Field of Classification Search
USPC ..... 347/49, 50, 86, 87
See application file for complete search history.

(56) References Cited

U.S. PATENT DOCUMENTS

| | | | | |
|---|---|---|---|---|
| 5,359,357 | A | 10/1994 | Takagi et al. | |
| 5,552,816 | A * | 9/1996 | Oda et al. | 347/86 |
| 6,312,105 | B1 | 11/2001 | Miyauchi | |
| 6,322,204 | B1 | 11/2001 | Blum et al. | |
| 6,390,697 | B1 | 5/2002 | O'Mera et al. | |
| 6,536,870 | B1 | 3/2003 | Takahashi et al. | |
| 6,824,243 | B2 | 11/2004 | Yamaguchi et al. | |
| 7,717,549 | B2 | 5/2010 | Rademakers et al. | |
| 7,845,762 | B2 | 12/2010 | Silverbrook | |
| 7,905,572 | B2 * | 3/2011 | Anderson et al. | 347/49 |
| 8,100,509 | B2 | 1/2012 | Silverbrook | |

FOREIGN PATENT DOCUMENTS

| | | |
|---|---|---|
| EP | 1122077 | 8/2001 |
| JP | 09-011500 | 1/1997 |

OTHER PUBLICATIONS

International Searching Authority. International Search Report Mail Date Dec. 20, 2012. Application No. PCT/US2012/035443 Filed date Apr. 27, 2012.

* cited by examiner

*Primary Examiner* — Anh T. N. Vo
(74) *Attorney, Agent, or Firm* — Dicke, Billig & Czaja, PLLC

(57) ABSTRACT

A printer assembly includes a carrier module and a first guide element. The carrier module includes side portions extending in a first orientation and a mounting portion to receive an ink cartridge. The first guide element is removably mounted on the carrier module and includes protrusions, extending outward beyond each side portion, to slidably engage a guide structure of a carriage cavity during at least a portion of removable insertion of the carrier module into the carriage cavity.

15 Claims, 9 Drawing Sheets

REMOVABLE GUIDE ELEMENT

BACKGROUND

Printers have become ubiquitous in the information age. Both small and large printers populate commercial enterprises while small printers can be found in many homes and most small businesses. Despite their widespread presence, many challenges remain in creating and adapting printers to meet strategic goals for a particular situation.

DETAILED DESCRIPTION

Figure 1A:
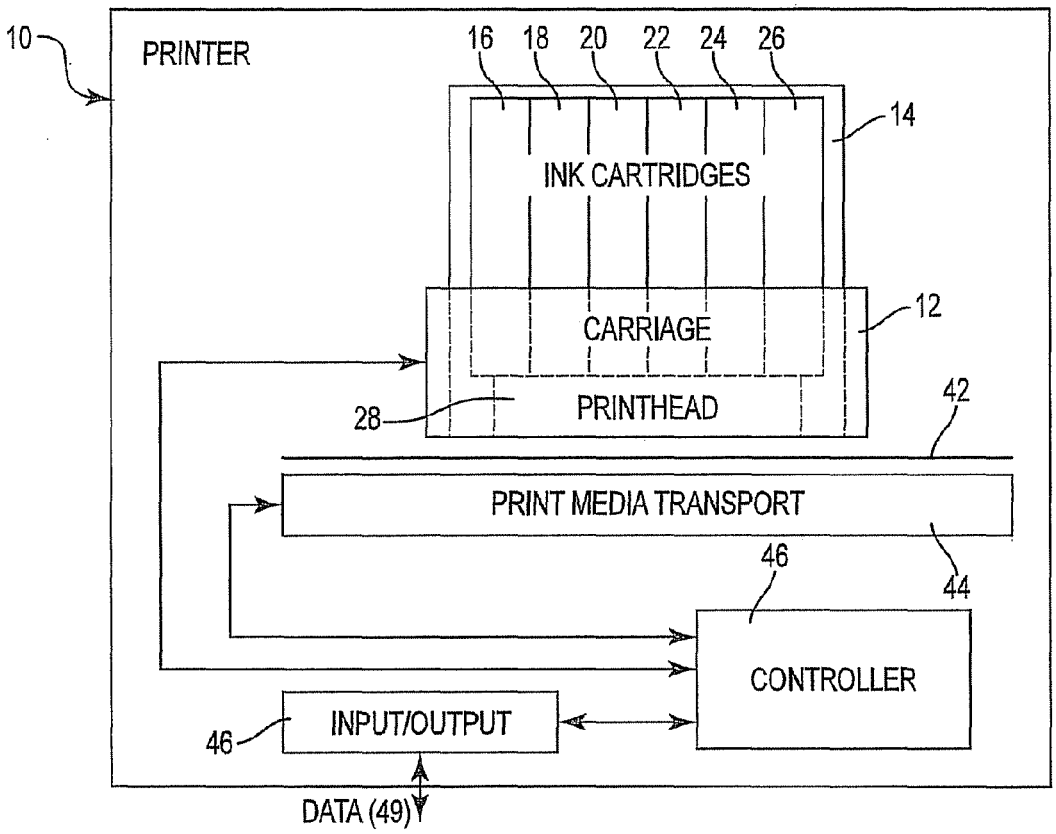
FIG. 1A is a block diagram schematically illustrating one example of a printer system in the present disclosure.

In the following detailed description, reference is made to the accompanying drawings which form a part hereof, and in which is shown by way of illustration specific examples and embodiments which may be practiced. In this regard, directional terminology, such as "top," "bottom," "front," "back," "leading," "trailing," etc., is used with reference to the orientation of the Figure(s) being described. Because components of the examples and embodiments can be positioned in a number of different orientations, the directional terminology is used for purposes of illustration and is in no way limiting. It is to be understood that other examples or embodiments may be utilized and structural or logical changes may be made without departing from the scope of the present disclosure. The following detailed description, therefore, is not to be taken in a limiting sense.

Examples of the present disclosure facilitate removable installation of a printer assembly into a carriage of a scanning-type printer. One example of a printer assembly in the present disclosure includes a carrier module and a first guide element. The carrier module includes a mounting portion for receiving an ink cartridge, a front exterior portion, and side portions that extend along a first orientation. A first guide element is removably mounted on the carrier module and includes protrusions extending outward beyond each side portion of the carrier module. The first guide element is spaced apart from the front exterior portion of the carrier module) along the first orientation, to slidably engage a corresponding guide structure of a carriage cavity, to maintain a minimum spacing between the front exterior portion of the carrier and a front interior portion of the carriage cavity during at least a portion of removable insertion of the carrier module into the carriage cavity.

In one example, the front interior portion of the carriage cavity includes protruding surface features, such as electrically conductive biasing elements (e.g. springs), and the front exterior portion of the carrier module includes protruding surface features, such as circuitry components, mechanical engagement features, fluidic or air seals, etc. Accordingly, the minimum spacing maintained via operative engagement of the first guide element with the second guide element of the carriage protects the delicate and sensitive protruding features, such as the collapsible biasing mechanisms on the front interior portion of the carriage cavity.

In some examples, the carrier module includes a printhead structure mounted on a bottom portion of the carrier module and includes a fluid communication pathway between the printhead structure and a fluid mounting portion of the carrier module to enable fluid communication from an ink cartridge to the printhead structure.

In one aspect of the example printer system, because the first guide element is removably mountable to the carrier module, it does not form a permanent part of the carrier module. Accordingly, if one or several components of the printer system change in shape, size, or location, then one can replace the first guide element with another guide element having features with a different size, shape, and/or location to accommodate the altered structural features of the components of the printer system. In just one example, in the situation in which a latch element on a bottom portion of an ink cartridge were re-designed to have a different shape (or size or location), then the first guide element is replaceable with another guide element having a differently designed, corresponding latch element to accommodate the re-designed latch element of the ink cartridge.

In another example, a first type of ink cartridge that acts as an on-board ink supply (i.e. no external off-axis ink supply) has a first type of latch element for being releasably secured to the carrier module while a second type of ink cartridge that acts primarily as an on-board pressure regulator (cooperable with an off-axis ink supply) has a second type of latch element for being releasably secured to the carrier module. Upon a decision to switch the first type of ink cartridge for the second type of ink cartridge (or vice versa) on a carrier module, examples of the present disclosure enable convenient replacement of the first guide element to enable provision of the appropriate reciprocating latch element on the carrier module to accommodate the different latch elements of the different types of ink cartridges.

This arrangement provided via examples of the printer systems of the present disclosure avoids the prior practice in which an entire carrier module would have to be replaced in order to provide an appropriate latch element of the carrier module to accommodate the latch element of the different type of ink cartridges.

In other examples, a replaceable first guide element provides a flexible response to design changes in the second guide element associated with design changes in a carriage or a flexible response to design changes in the carrier module. For instance, if a length or depth of the carriage was modified such that a position of the second guide element were altered relative to the original design, one can replace the first guide element with another differently shaped or sized first guide element that meets the altered design of the carriage.

Accordingly, in at least one sense, examples of a first guide element in the present disclosure enable printer systems to be modular in nature. In other words, by providing a first guide element that is replaceable and removably mounted relative to a carrier module, the components (e.g. the carrier module, the carriage, the ink cartridge) become modular elements which can be altered in their designs in some respects without necessarily dictating that the designs of the other components be altered to accommodate the changes in the other respective components.

These examples, and other examples, are described and illustrated in association with FIGS. 1A-9B.

FIG. 1 is a block diagram schematically illustrating one example of an inkjet printer 10 in the present disclosure. As shown in FIG. 1, printer 10 includes a carriage 12 carrying a printhead module 14. Printhead module 14 includes a series of ink cartridges 16, 18, 20, 22, 24, and 26 connected to a printhead 28. Each ink cartridge 16-26 represents generally the operative components used to hold a volume of ink and to regulate the flow of ink to printhead 28, for example, a single color of ink such as black (K), yellow (Y), cyan (C), magenta (M), light cyan (CL) and light magenta (ML). Each ink cartridge 16-26 may itself be a removable component in module 14 or a permanent component of module 14. Printhead 28 represents generally the operative components needed to expel ink from module 14 on to print media 42. For example, via the pressure regulation in cartridge 16, black ink flows from cartridge 16 through a filter to printhead 28, where it is ejected on to print media 42. In some instances, this type of arrangement is referred to as an "on-axis" ink supply system. In other examples, as described below, an "off-axis" ink supply is used.

Inkjet printhead 28 is typically a small electromechanical assembly that contains an array of miniature thermal, piezoelectric or other devices that are energized or activated to eject small droplets of ink out of an associated array of nozzles. A typical thermal inkjet printhead, for example, includes a nozzle plate arrayed with ink ejection nozzles and firing resistors formed on an integrated circuit chip. In some examples, printhead 28 is formed as a series of discrete printheads each serving just one or several cartridges 16-26, or in other examples, printhead 28 is formed as a single printhead serving all of cartridges 16-26 through multiple nozzle arrays and corresponding fluid delivery channels.

A print media transport mechanism 44 advances print media 42 past carriage 12 and printhead 28. For a movable, scanning carriage 12, media transport 44 typically will advance media 42 incrementally past carriage 12, stopping as each swath is printed and then advancing media 42 for printing the next swath. An electronic controller 46 is operatively connected to carriage 12, ink cartridges 16-26, printhead 26, and media transport 44. Controller 46 communicates with external devices through an input/output device 48, including receiving print data 49 for inkjet imaging. The presence of an input/output device 48 in FIG. 1, however, does not preclude the operation of printer 10 as a standalone unit. By coordinating the relative position of carriage 12 with media 42 and the ejection of ink drops, controller 46 produces the desired image on media 42.

Figure 1B:
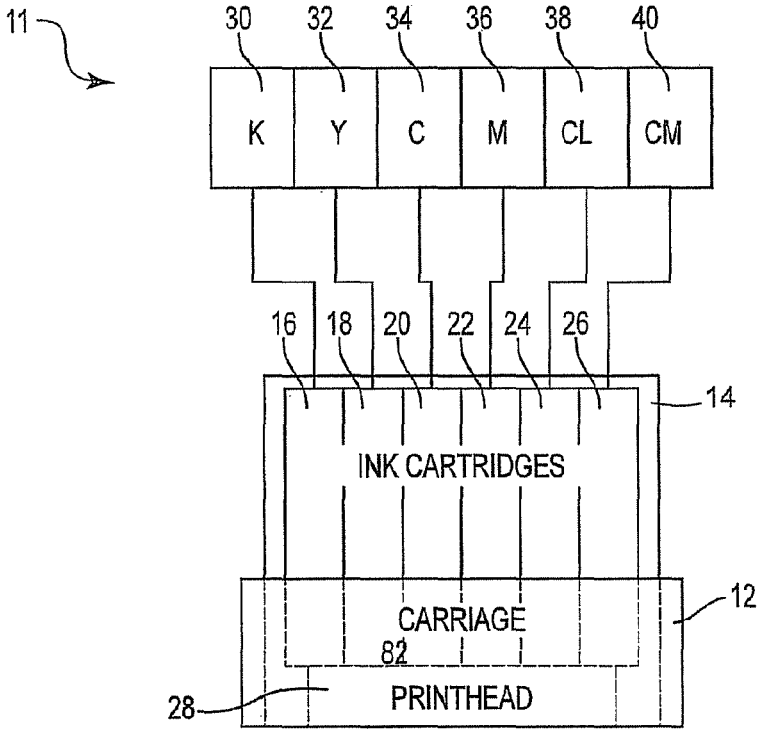

Some examples of the printer system of the present disclosure are arranged with an "off-axis" ink supply. Accordingly, one example of a printer system 11 is shown in FIG. 1B. In one embodiment, printer system 11 includes at least substantially the same features and attributes as printer system 10 (FIG. 1A), except providing remote ink supplies (30-40) that feed ink to each cartridge 16-26, respectively, as shown in FIG. 1B. In one aspect, the ink supplies 30-40 are located remotely from carriage 12, and therefore do not travel with carriage 12 across a scan axis. With this arrangement, for example, black ink is pumped or otherwise introduced into cartridge 16 from ink supply 30 to a pressure regulator chamber in cartridge 16. Ink flows from the regulator chamber through a filter to printhead 28, where it is ejected on to print media 42.

Figure 2A:
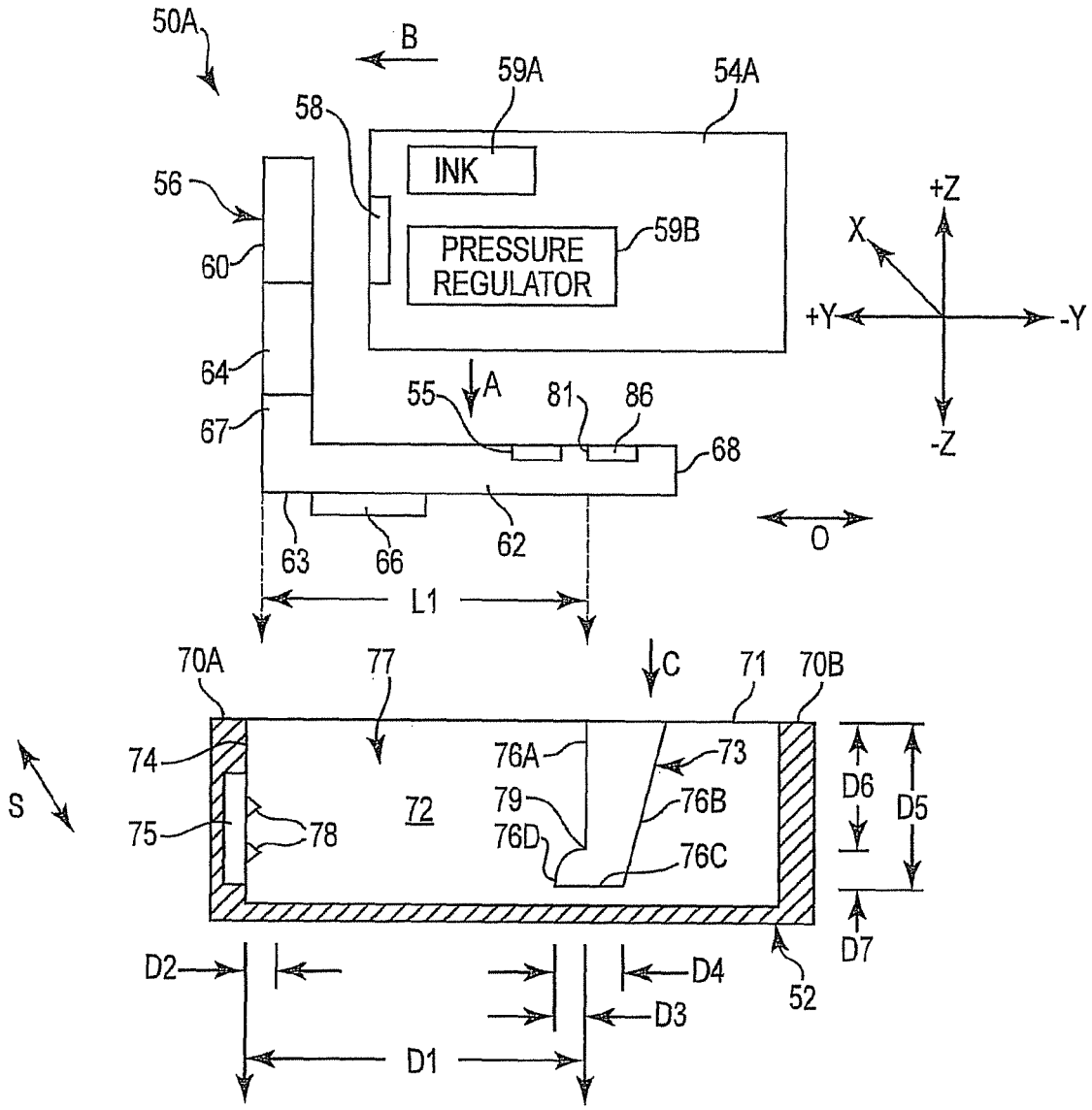
FIG. 2A is a block diagram schematically illustrating one example of a printer system in the present disclosure.

FIG. 2A is a diagrammatic side view in a diagram that schematically illustrates one example of a printer system 50A in the present disclosure. In one embodiment, the printer system 50A includes at least substantially the same features and attributes as printer system 10, as previously described in association with FIG. 1A.

As shown in FIG. 2A, in one example a printer system 50A includes a carriage 52, an ink cartridge 54A, and a carrier module 56.

As shown in FIG. 2A, the carrier module 56 includes a first frame portion 60 and a second frame portion 62, which extends along a first orientation (represented by directional arrow O) and which is generally transverse to the first frame portion 60. The first frame portion 60 of carrier module 56 includes controller circuitry 64, a portion of which is exposed on a front exterior portion 67.

The second frame portion 62 of carrier module 56 includes a rear portion 68 spaced apart from and generally opposite the front exterior portion 67. In one example, the second frame portion 62 also includes a printhead structure 66 (like printhead 28 in FIG. 1A) exposed on a bottom portion 63. In another example, second frame portion 62 includes a mounting portion 55 by which ink cartridge 54A is removably secured onto carrier module 56. Once ink cartridge 54A is secured onto carrier module 56, the ink cartridge 54A is treated as part of carrier module 56 for purposes of insertion into carriage 52.

In another aspect, the second frame portion 62 of carrier module 56 includes a first guide element 86 that is removably mounted in a slot 81 of second frame portion 62. In one example, the first guide element 86 and at least a portion of mounting portion 55 are embodied in a single structure while in other examples, the first guide element 86 and the mounting portion 55 comprise separate and independent structures. Further details regarding first guide element 86 are described below and also later described in association with FIGS. 3A-3C.

Among other components, ink cartridge 54A includes ink portion 59A, a pressure regulation component 59B, and controller circuitry 58 as shown in FIG. 2A. When ink cartridge 54A is releasably secured to carrier module 56, an electrical communication pathway is between the controller circuitry 58 of cartridge 54A and controller circuitry 64 of carrier module 56 and a fluid communication pathway is established between ink portion 59A and an ink passageway (in one example, shown as at least element 188 in FIG. 6A) in second frame portion 62.

As further shown in FIG. 2A, in one example carriage 52 comprises a frame selectively movable along a scan axis (as represented by directional arrow S and generally parallel to axis X) for printing via printhead structure 66 of carrier module 56. In one example, carriage 52 includes a cavity 77 having opposite end walls 70A, 70B and opposite side walls 72 (with just one side wall 72 shown in this partial sectional view of cavity 77). The end wall 70A includes a front interior portion 74, which includes an exposed portion of controller circuitry 75 with protruding surface features 78. In one example, the protruding surface features 78 comprise a collapsible biasing mechanism, such as electrically conductive springs electrically connected to controller circuitry 75. However, it will be understood that in some examples, surface features 78 can include other elements in addition to or instead of a collapsible biasing mechanism. In one aspect, the collapsible biasing mechanism embodied via surface features 78 provides at least a releasable mechanical and electrical connection between the controller circuitry 75 at front interior portion 74 of cavity 77 of carriage 52 and the controller circuitry 64 via front exterior portion 67 of carrier module 56.

Among other components, each side wall 72 of cavity 77 in carriage 52 includes a second guide element 73. In general terms, second guide element 73 defines a recessed pathway in side wall 72 that is sized and shaped to slidably receive and guide movement of first guide element 86 (that is removably mounted onto second frame portion 62 of carrier module 56), thereby guiding installation of carrier module 56 into cavity 77 of carriage 52. It will be understood that in some examples both carrier module 56 and carriage 52 may include additional features independent of first guide element 86 and second guide element 73, respectively, that further constrain engagement of carrier module 56 relative to carriage 52. These additional features are not shown for illustrative clarity and in order to highlight the interaction of first and second guide elements 86 and 73.

As shown in FIG. 2A, in one example the second guide element 73 includes a generally straight front portion 76A, a rear angled portion 76B, a bottom portion 76C, and a second recess portion 76D. The generally straight front portion 76A extends from a top edge 71 of cavity 77 to a terminal end 79. The second recess portion 76D forms a transition between the terminal end 79 of front portion 76A and the bottom portion 76C such that second recess portion 76D defines a pocket that extends generally in a direction toward the front interior portion 74 of carriage 52.

As shown in FIG. 2A, in one example front portion 76A of second guide element 73 is spaced apart from front interior portion 74 of cavity 77 by a distance (D1). In one aspect, a front edge of first guide element 86 is spaced apart from front exterior portion 67 of carrier module 56 by a length L1. In another aspect, the surface features 78 at front interior portion 74 of cavity 77 protrude by a distance less than a second distance (D2). Accordingly, by setting length L1 to be shorter than the distance (D1) at least by a distance (D2), this arrangement ensures that front exterior portion 67 of carrier module 56 will not contact surface features 78 on front interior portion 74 of cavity 77 at least during a portion of insertion of carrier module 56 into cavity 77, as will be further described below.

In another aspect, as further shown in FIG. 2A, second recess portion 76D has a depth (D3), as measured relative to generally straight front portion 76A. In one example, the depth (D3) of second recess portion 76D is not less than the second distance D2. This relationship ensures that upon reception of first guide element 86 into the pocket of second recess portion 76D, the second guide element 73 will enable front exterior portion 67 of carrier module 56 to contact and engage front interior portion 74 of cavity 77, when selectively caused as further described below.

In another aspect, front portion 76A has a length (D6) extending from top edge 71 of cavity 77 to terminal end 79 while rear angled portion 73 has a length exceeding a length of front portion 76A and extending to a depth (D5) within cavity 77. In one aspect, the recess portion 76D has a height (distance D7) while bottom portion 76C has a length (D4) greater than depth D3 of the pocket defined by recess portion 76D, thereby allowing movement of first guide element 86 in a Y-axis orientation upon the first guide element 86 generally reaching the bottom of the recess defined by second guide element 73.

With these relationships in mind, the first guide element 86 and the second guide element 73 are shaped and positioned to cause front exterior portion 67 of carrier module 56 to be spaced apart by a minimum distance (e.g. D2) from surface structures 78 on front interior portion 74 of cavity 77 (on front end wall 70A) during at least a portion of slidable insertion of carrier module 56 into cavity 77. In one example, this minimum spacing is maintained at least until first guide element 86 has descended (represented by directional arrow C and parallel to directional reference Z) beyond the terminal end 79 of front portion wall 76A of guide element 73, after which first guide element 86 becomes free to move along the first orientation toward front interior portion 74 of cavity 77 of carriage 52 (as represented by directional arrow B and parallel to directional reference Y) such that first guide element 86 comes to rest at least partially within the pocket defined by second recess portion 76D. Accordingly, carrier module 56 generally has completed its vertical descent within cavity 77 of carriage 52.

As later described in association with at least FIGS. 8A-8B, upon application of a force to carrier module 56, the carrier module 56 rotates upward (a Z component) and forward toward end wall 70A (a Y component) to cause front exterior portion 67 of carrier module 56 to releasably engage the front interior portion 74 of cavity 77 of carriage 52. This releasable engagement establishes at least a mechanical and electrical connection between carrier module 56 and carriage 52. As will be further described later in association with FIGS. 9A-9B, other latching mechanisms (not shown) maintain the front exterior portion 67 of carrier module 56 in the engaged position against the front interior portion 74 of carriage 52.

Figure 2B:
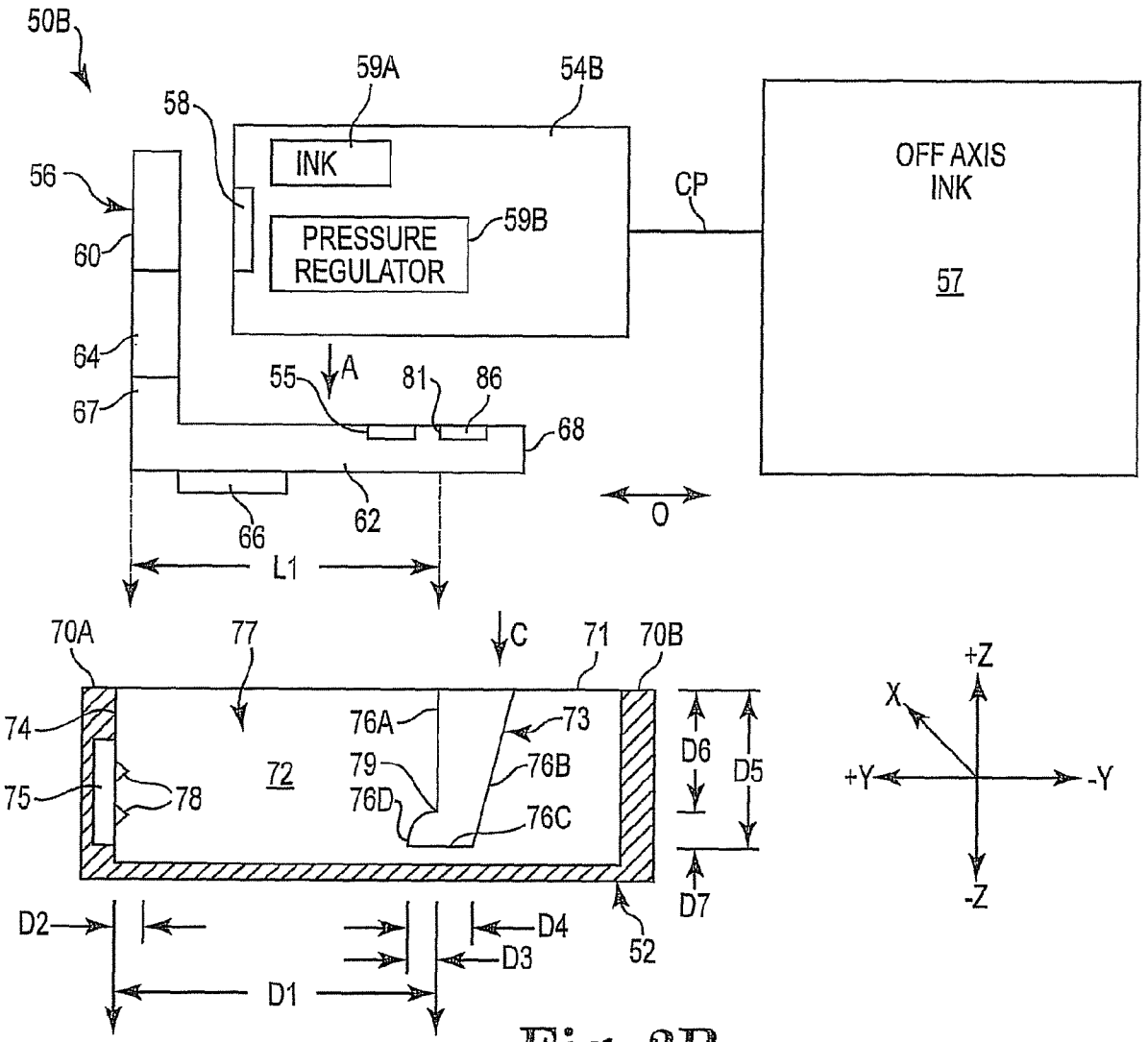
FIG. 2B is a block diagram schematically illustrating one example of a printer system in the present disclosure.

FIG. 2B is a side view schematically illustrating a printer system 50B having substantially the same features as printer system 50A of FIG. 2A, except further comprising an off-axis ink supply 57 connected via a fluid communication pathway (C) to ink cartridge 54B. In this example, while ink cartridge 54B includes an ink portion 59A, the ink cartridge 54B functions primarily as an onboard pressure regulator (via regulator component 59B) and an intermediate ink container through which ink flows from off-axis ink supply 57 to printhead structure 66. In other respects, the printer system 50B includes at least substantially the same features and attributes as printer system 50A, as previously described in association with at least FIG. 2A such that carrier module 56 is guided via respective guide elements 86, 73 into removable installation within cavity 77 of carriage 52. Moreover, in one example, with ink cartridge 54B acting as an on-board pressure regulator, ink cartridge 54B does not function as a consumable or replaceable component and therefore ink cartridge 54B is considered to be a permanent part of carrier module 56.

Figure 2C:
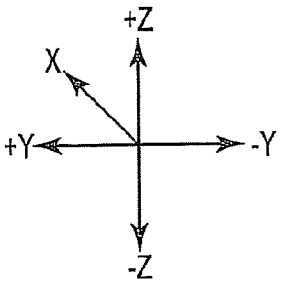
FIG. 2C is a block diagram schematically illustrating one example of a printer system in the present disclosure.
Figure 2C:
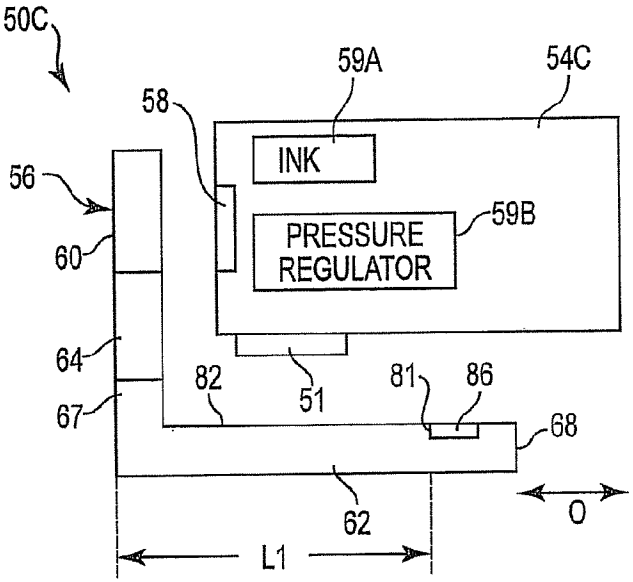

FIG. 2C is a side view schematically illustrating a portion of an example of a printer system 50C of the present disclosure. In one embodiment, the printer system 50C includes at least substantially the same features and attributes as printer system 50A (as previously described in association with at least FIG. 2A), except with ink cartridge 54C including a printhead structure 51 (instead of the printhead structure 66 mounted on carrier module 52, as in FIG. 2A). In other respects, the components of printer system 50C enable carrier module 56 to be guided via respective guide elements 86, 73 into removable installation within cavity 77 of carriage 52, in a manner substantially the same as previously described for printer system 50A (FIG. 2A).

Figure 3B:
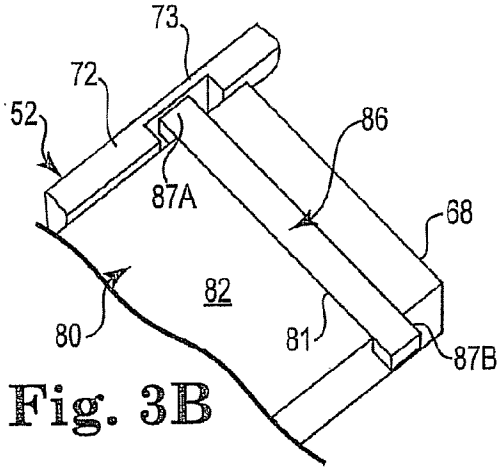
FIG. 3B is an isometric view schematically illustrating one example of a first guide element interacting with a corresponding second guide element in the present disclosure.
Figure 3C:
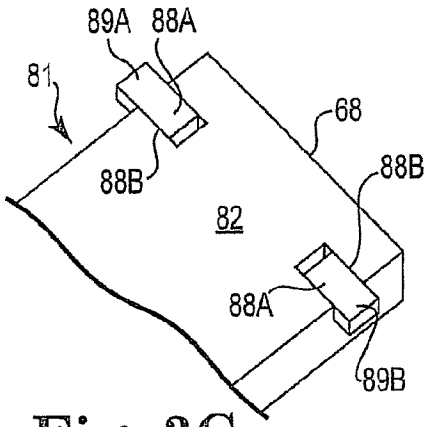
FIG. 3C is an isometric view schematically illustrating one example of a removably insertable guide element in the present disclosure.
Figure 3A:
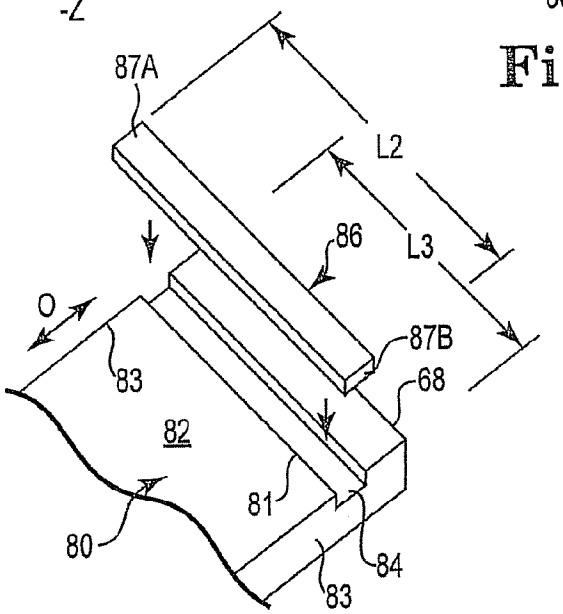
FIG. 3A is an isometric view schematically illustrating one example of a movably insertable guide element in the present disclosure.

FIG. 3A is an isometric view schematically illustrating first guide element 86 positioned for removable mounting relative to a carrier module 80, according to one example of the present disclosure. In one example, the carrier module 80 and first guide element 86 include at least substantially the same features and attributes as carrier module 52 and first guide element 86, as previously described in association with at least FIGS. 2A-2C. As shown in FIG. 3A, carrier module 80 defines side portions 83 extending along a first orientation (represented by directional arrow O) and a slot 84 defined with upper surface portion 82. It will be understood that due to FIG. 3A being a schematic representation, surface portion 82 does not necessarily represent a homogeneous structure. Slot 84 extends transversely to the first orientation and is located adjacent to rear portion 85 of carrier module 80. In one aspect, first guide element 86 comprises an elongate member having opposite end portions 87A, 87B and defining a length (L2) that exceeds a length (L3) of slot 84. Accordingly, with first guide element 86 mounted in slot 84 as shown in FIG. 3B, opposite end portions 87A, 87B protrude outwardly from side portions 83 of carrier module 56. Accordingly, with first guide element 86 mounted on carrier module 56, end portions 87A, 87B function as protrusions of carrier module 56. However, because first guide element 86 is selectively removable from slot 84, the first guide element 86 can be replaced by other guide elements that fit within slot 84 but that have differently sized, shaped, and/or oriented protrusions to cooperate with an appropriate second guide element 73 of a cavity 77 of a carriage 52.

In one aspect, slot 84 defines a front edge 81 (also shown in FIG. 2A-2C) from which the distance L1 is measured to the front exterior portion 67 of carrier module 56.

FIG. 3B is a top isometric view schematically illustrating first guide element 86 mounted within slot 84, according to one example in the present disclosure, in which an end portion 87A of first guide element 86 releasably engages a corresponding second guide element 73 in side wall 72 of carriage 52.

FIG. 3C is an isometric view schematically illustrating a pair of guide elements 88A removably mounted in slots 88B defined within the upper surface portion 82 of a carrier module 81, according to one example in the present disclosure. Each guide element 88A includes an end portion 89A, 89B, similar to end portions 87A, 87B in FIGS. 3A-3B. In one example, guide elements 88A provide at least substantially the same features and attributes as first guide element 86 (as previously described in association with at least FIGS. 2A-3B), except being provided as two separate elements instead of as a single elongate member as shown in FIGS. 3A-3B.

Figure 4A:
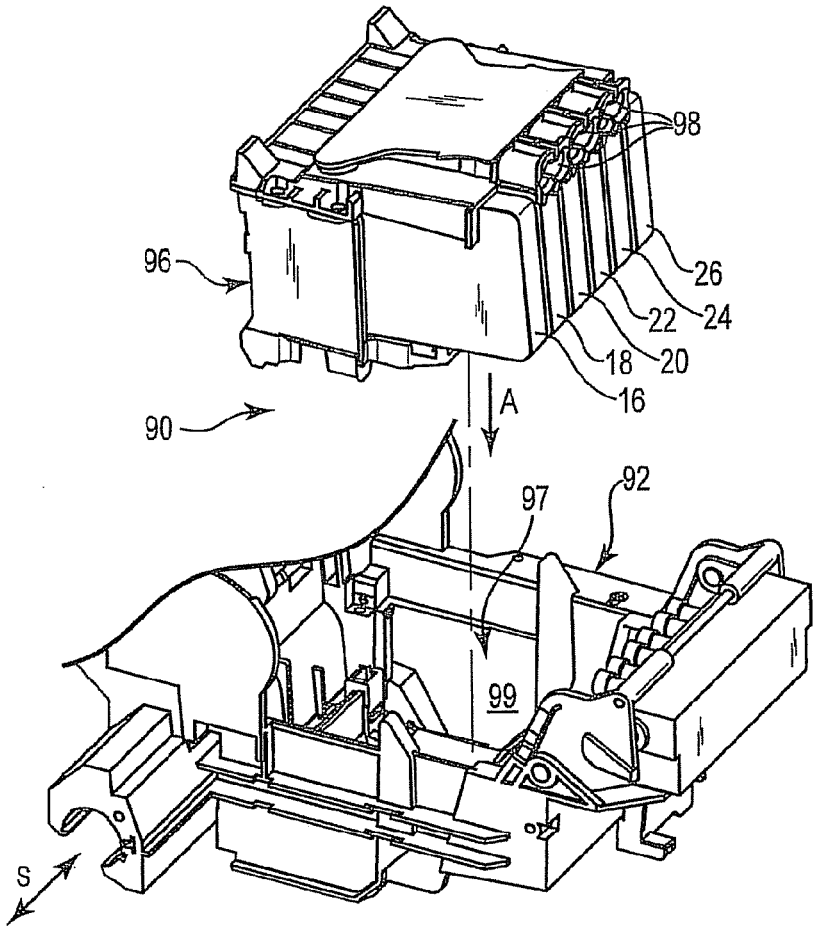
FIG. 4A is an isometric view schematically illustrating one example of a printhead module removably insertable into a carriage, according to one example of the present disclosure.

FIG. 4A is an isometric view schematically illustrating a printhead module 96 positioned to be removably inserted into a carriage 92, according to one example of the present disclosure. In general terms, FIG. 4A illustrates a carriage 92 as just one example of a carriage 52 previously described in association with FIGS. 2A-2C. As shown in FIG. 4A, carriage 92 defines a cavity 97 into which a carrier module 96 is removably inserted in a manner consistent with the removable insertion of carrier module 56 into cavity 77 of carriage 52 (FIGS. 2A-2C, 3A-3B). It will be understood that the side walls 99 of cavity 97 in FIG. 4A are generally undefined for illustrative purposes, with one example of a portion of side walls 99 of cavity 97 of carriage 90 shown in more detail in association with FIG. 7.

Figure 4B:
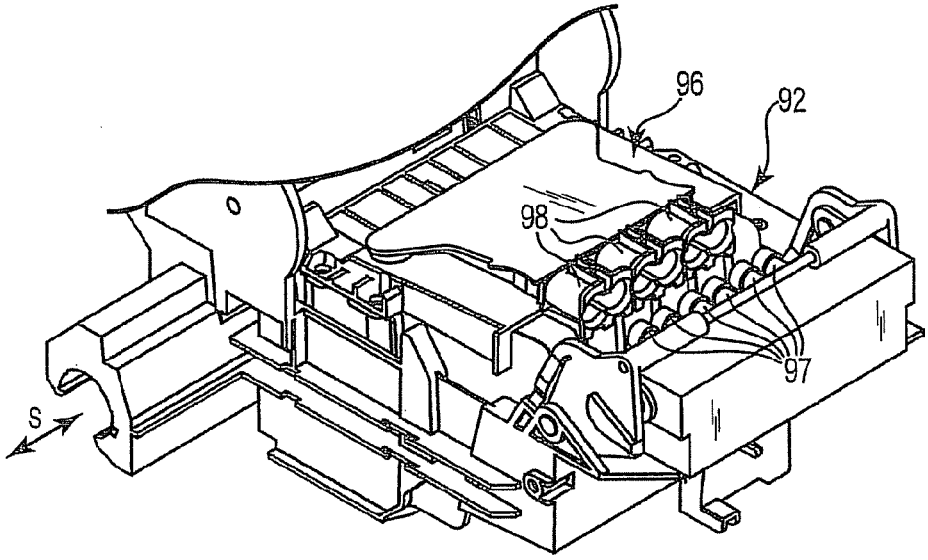
FIG. 4B is an isometric view schematically illustrating one example of the printhead module FIG. 4A as removably inserted into a carriage, according to one example of the present disclosure.

FIG. 4B is an isometric view schematically illustrating the carrier module 96 of FIG. 4A after its removable insertion into cavity 97 of carriage 92, according to one example of the present disclosure. It will be understood that further actions will be completed, such as releasable engagement of the ink supply ports 97 (from an off-axis ink supply) to needle couplings 98 that are in communication with corresponding cartridges 16-26, operation of latches to further secure printhead module 96, and related actions to complete preparation of carriage 92 for printing. Thereafter, printer system 90 is prepared to initiate scanning movement (as represented by directional arrow S) of a carriage 92 for printing (via a printhead of carrier module 96) on a print media.

Figure 6A:
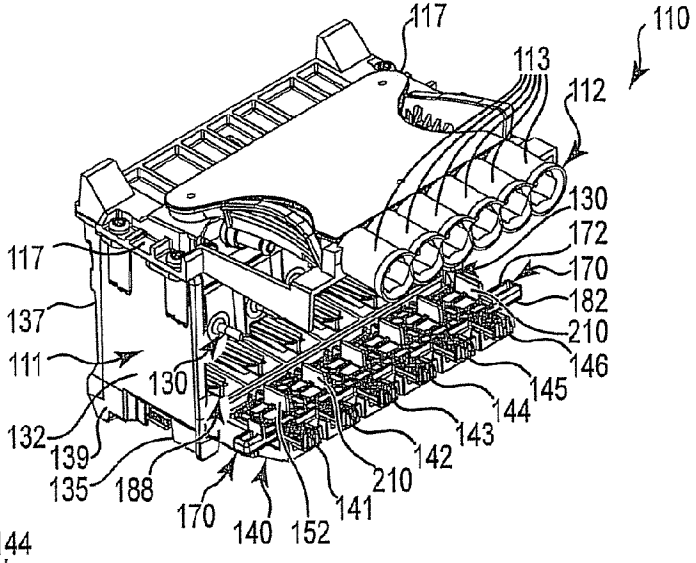
FIG. 6A is a top, front, and right isometric view schematically illustrating one example of a printhead module in the present disclosure.
Figure 5A:
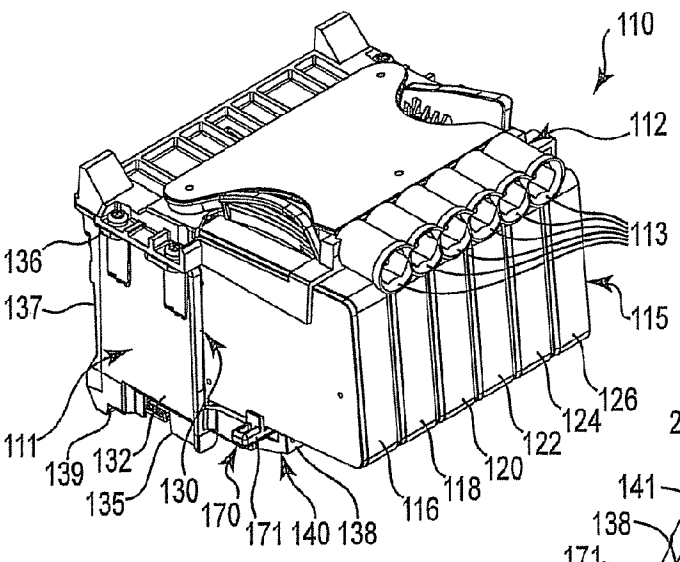
FIG. 5A is a top, front, and right isometric view schematically illustrating one example of a printhead module in the present disclosure.
Figure 5B:
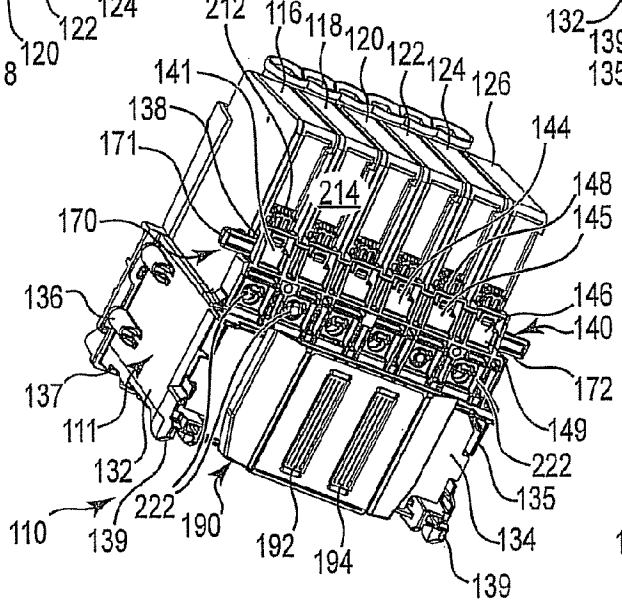
FIG. 5B is a bottom, front, and right isometric view schematically illustrating one example of a printhead module in the present disclosure.

FIG. 5A is an isometric view schematically illustrating one example of a printhead module 110 in the present disclosure with the isometric view providing top, front, and right side views while FIG. 5B further illustrates the printhead module 110 from a bottom, front, and right side isometric view. FIG. 6A is an isometric view like FIG. 5A, except with ink cartridges 116-126 removed from printhead module 110 for illustrative purposes. In one example, printhead module 110 includes at least substantially the same features and attributes as carrier module 56 as previously described in association with at least FIGS. 2A-2B in which a carrier module (e.g. carrier module 56) includes a printhead structure (e.g. printhead structure 66).

As shown in FIG. 5A, in one example printhead module 110 comprises a carrier structure 111 onto which an array 115 of ink cartridges 116-126 are removably mounted. In one aspect, a front portion of ink cartridges (not visible in FIG. 5A) are received within a cavity 130 defined by carrier structure 111. In one example, cavity 130 is at least partially defined by side walls 132 and front exterior portion 137 of carrier structure 111.

In one example, each ink cartridge 116-126 comprises an on-board pressure regulator and ink tank (like cartridge 54B in FIG. 2B) and through which an off-axis ink supply (element 57 in FIG. 2B) will fluidly communicate to printhead structure 190 (FIG. 5B). In this example, ink cartridge 116-126 acts as a permanent component of printhead module 110 in the sense that ink cartridges 116-126 are not treated as a consumable component (in which the component would be replaced upon consumption of its contents, such as ink).

In one example, as further shown in FIG. 5A, printhead module 110 includes an array 112 of needle couplings 113 mounted at a top portion 136 of carrier structure 111 and establish a fluid communication pathway with an array of ink supply ports, such as ink supply ports 97 shown in FIG. 4B. While not shown in FIG. 6A, it will be understood that each needle coupling 113 is in fluid communication with an interior of ink cartridge 116-126. Via this arrangement, ink is communicated from an off-axis ink supply (e.g. supply 57 in FIG. 2B) through ink supply ports (e.g. ports 97 in FIG. 4B) into needle couplings 113 for communication, via cartridges 116-126, to printhead structure 190, shown in FIG. 5B.

As further shown in FIGS. 5A-5B and 6A, carrier structure 111 includes a rear portion 138 including an array 140 of mounting structures 141-146 with each respective mounting structure (141-146) positioned and shaped to removably receive a corresponding ink cartridge (116-126). Mounting structures 141-146 also support first guide element 170, whose end portion 171 is shown in FIGS. 5A-5B and 6A as protruding from a side portion of one outermost mounting structure 141. As best seen in FIGS. 5B and 6A, end portion 172 of first guide element 170 protrudes outward beyond a side portion of an outermost mounting structure 146.

With further reference to FIG. 5B, a bottom portion 135 of carrier structure 111 includes a printhead structure 190 having arrays 192, 194 of nozzles. FIG. 5B also further illustrates a bottom view of mounting structures 141-146 that extend rearward from a main portion 134 of carrier structure 111 and are positioned rearward of printhead structure 190. In one aspect, ink cartridges 116-126 have a length such that a rear portion of each ink cartridge 116-126 extends rearward beyond an end 148 of each mounting structure 141-146.

As further shown in FIG. 6A, carrier module 111 includes a fluid mounting portion 188 onto which a fluid communication portion of each ink cartridge 116-126 mounts to establish a fluid communication pathway from each ink cartridge 116-126 to the printhead structure 190.

Figure 6B:
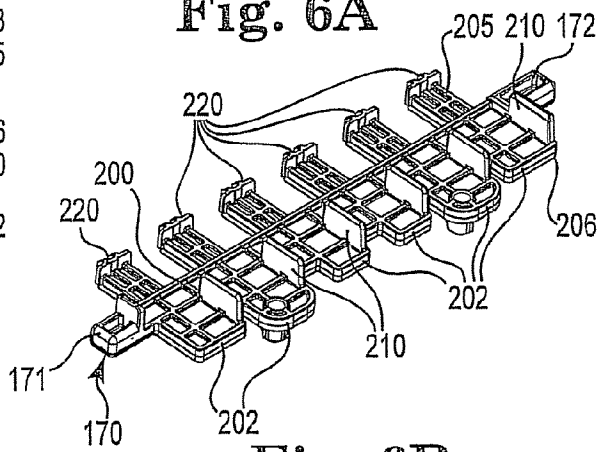
FIG. 6B is an isometric view schematically illustrating one example of a replaceable guide element for a printhead module in the present disclosure.

In addition, FIGS. 6A-6B further illustrate one example of a first guide element 170. As shown in FIGS. 6A-6B, first guide element 170 includes an elongate spine 200 and a plurality of spaced apart fingers 202 that each extend from the spine 200 transversely relative to a longitudinal axis of the spine 200. In one aspect, as shown in FIG. 6A, each finger 202 is positioned to be removably mounted within a recess 150 of each of the mounting structures 141-146. In another aspect, spine 200 interposed is between opposite end portions 205, 206 of each finger 202. A top surface of end portion 206 of each finger 202 includes a latch element 210 to removably mount a reciprocating latch element 212 on a bottom portion 214 of an ink cartridge 116-126 (as best seen in FIG. 5B), thereby removably securing a respective ink cartridge 116-126 to the carrier structure 111 of the printhead module 110. Meanwhile, the opposite end portion 205 of each finger 202 of guide element 170 includes a mounting element 220 to secure a respective finger 202 to a inner portion 222 of each mounting structure 141-146, and thereby secure the first guide element 170 to the carrier structure 111.

In another aspect, the end portions 171, 172 of the first guide element 170 are defined by opposite end portions of the spine 200 and all the fingers 202 are sandwiched as a group between the opposite end portions of the spine 200 that define end portions 171, 172.

In another example, in the case in which each ink cartridge 116-126 comprises a replaceable on-axis ink supply, the respective fingers 202 of first guide element 170 are separate and independent of each other (omitting a common spine 200) with one finger 202 being received in one mounting structure 141-146. Each finger 202 includes its own latch element, which may be differently shaped and/or sized than latch element 210 and which may include movable components. In one aspect, the separate fingers 202 are secured to the mounting structures 141-146 via at least inner portion 222 of each respective mounting structure 141-146. In another aspect, at least the rear portion 148 of each mounting structure 141-146 is movable independent of the other respective mounting structures 141-146, thereby facilitating removable installation on-axis ink cartridges 116-126 independently of each other.

In this example in which each ink cartridge 116-126 comprises a replaceable on-axis ink supply and the first guide element includes separate and independent fingers 202 (omitting the spine 200 shown in at least FIGS. 6A, 6B), the fingers 202 in the outermost mounting structures 141 and 146 include protrusions having features and attributes substantially the same as the features and attributes of end portions 171, 172, as previously described above. In one example, this arrangement of separate fingers 202 (at the outermost mounting structures 141 and 146 defining protrusions that act as engagement features) includes substantially the same features and attributes as the separate guide elements 88A having end portions 89B act as engagement features, as previously described in association with FIG. 3C.

Figure 6C:
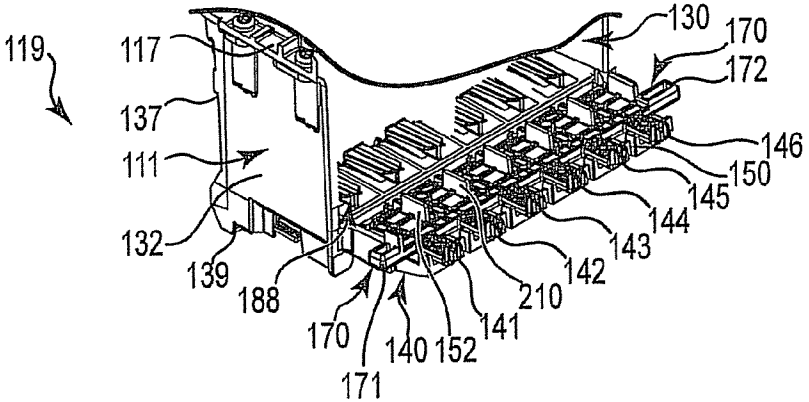
FIG. 6C is a top, front, and right isometric view schematically illustrating one example of a printhead module in the present disclosure.

FIG. 6C is an isometric view schematically illustrating one example of a printhead module in the present disclosure. As shown in FIG. 6C, the printhead module 119 includes at least substantially the same features and attributes as printhead module 110 (FIG. 5A-5B, 6A) except omitting the array 112 of needle couplings 113 (and any related shrouds) because the printhead module 110 employs ink cartridges in an on-axis ink supply format in which each ink cartridge defines a self-contained ink supply. While printhead module 119 includes ink cartridges 116-126 (as shown in FIGS. 5A-5B), FIG. 6C omits ink cartridges 116-126 solely for illustrative purposes. In one aspect, the ink cartridges define a consumable component in the sense that once ink is depleted from the cartridges, the cartridge will be replaced with a cartridge full of ink in order to resume operation of the printhead module 119 and the printer system.

Figure 7:
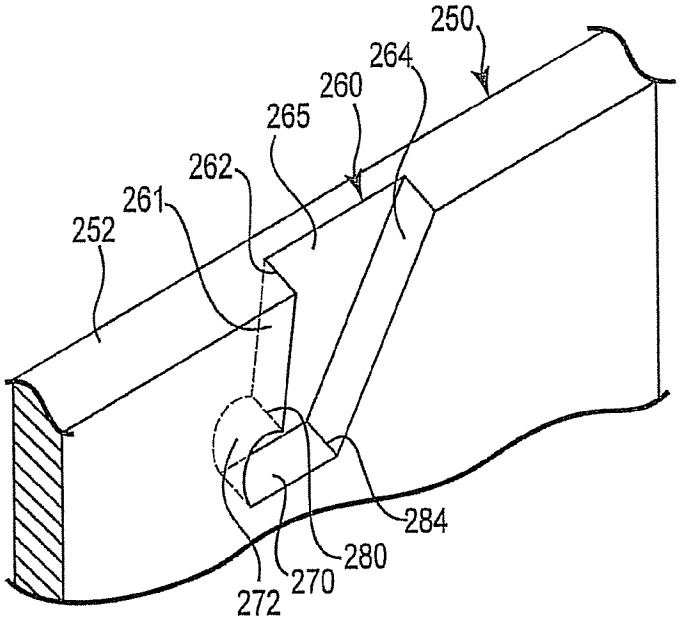
FIG. 7 is an isometric view schematically illustrating one example of a guide element of a carriage in the present disclosure.

FIG. 7 is an isometric view schematically illustrating one example of a guide element 260 in a side wall 250 of a carriage cavity in the present disclosure. In one example, guide element 260 includes at least substantially the same features and attributes as guide element 73, as previously described in association with at least FIGS. 2A-2C and FIG. 3B. As shown in FIG. 7, guide element 260 is defined in a portion of side wall 250 of a cavity of carriage (like carriage 52 in FIGS. 2A-2C). In one example, guide element 260 includes a front portion 261, a rear angled portion 264, a bottom portion 270, and a curved recess portion 272. The front portion 261 extends from a top edge 262 of side wall 250 and extends downward to a terminal end 280. In another aspect, the curved recess portion 272 defines a transition between a terminal end 280 of front portion 261 and the bottom portion 270 and defines a pocket extending toward a front interior portion of a cavity of carrier (e.g. front interior portion 74 of carrier 52).

Figure 8A:
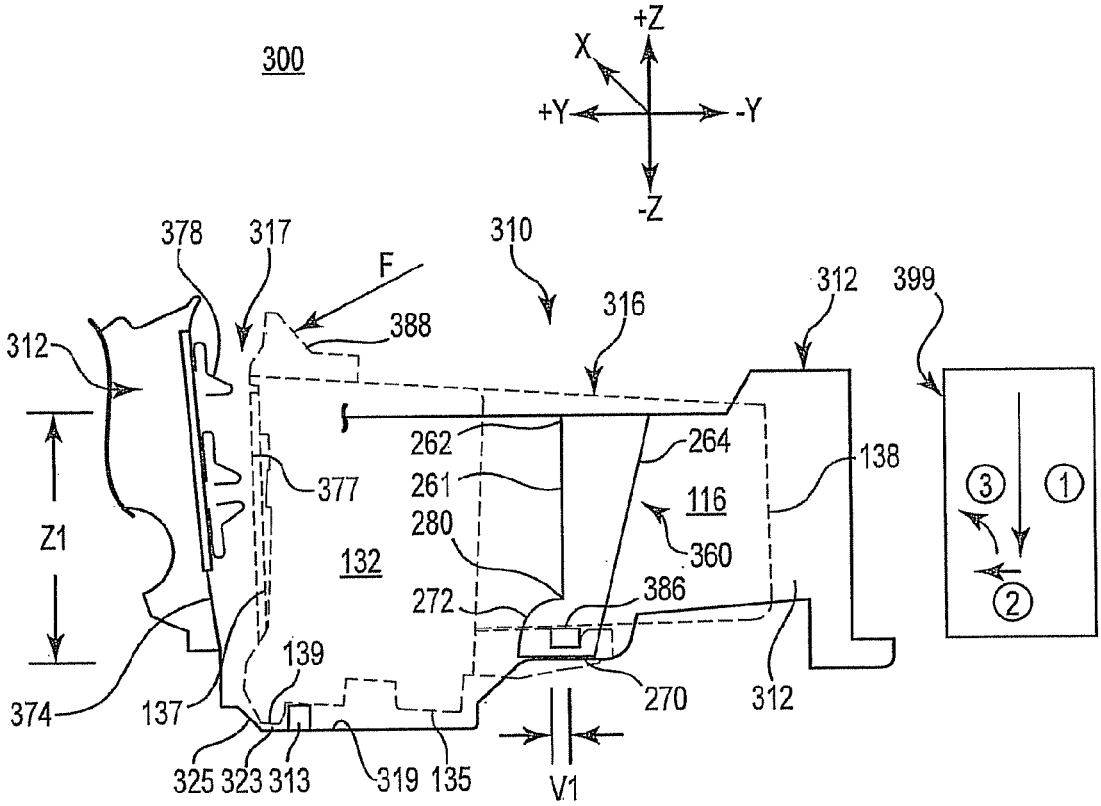
FIG. 8A is a front plan view schematically illustrating a printhead module in a first position during removable installation into a carriage, according to one example of the present disclosure.
Figure 8B:
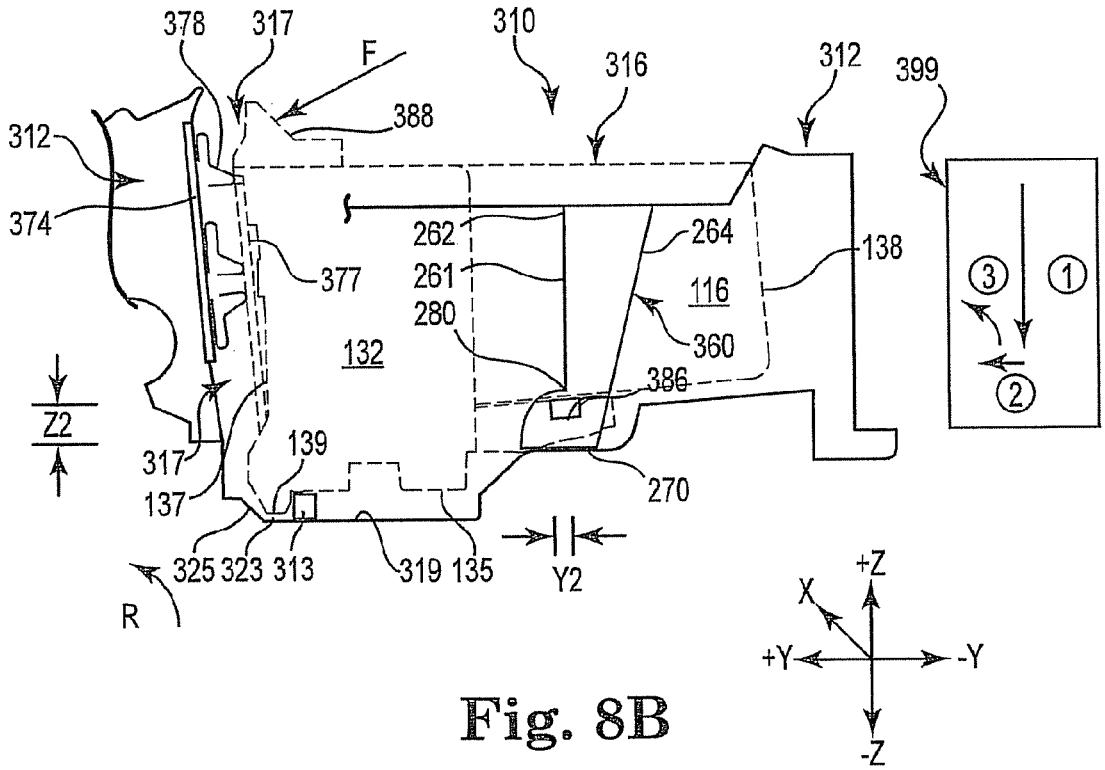
FIG. 8B is a front plan view schematically illustrating a printhead module in a second position during removable installation into a carriage, according to one example of the present disclosure.

FIG. 8A is a front plan view schematically illustrating a printhead module in a first position during removable installation into a cavity of a carriage, according to one example of the present disclosure. In one example, printer system 310 includes at least substantially the same features and attributes of printer system having ink cartridges 116-126 as on-board ink supplies, as previously described in association with at least some of FIGS. 2A-7. As shown in FIG. 8A, a printhead module 316 (shown in dashed lines for illustrative clarity) has been at least partially slidably inserted into cavity 317 of carriage 312 (like cavity 77 of carriage 52 in FIG. 2A and cavity 97 of carriage 92 in FIG. 4A) via slidable engagement of first guide element 386 of the printhead module 316 within the second guide element 260 of the cavity 317 of carriage 312 (in a manner substantially similar to that previously described in association with at least FIGS. 2A-2C). It is noted that the reference numerals of second guide element 360 refer to corresponding elements of guide element 260 in FIG. 7.

In this position shown in FIG. 8A, first guide element 386 is resting at bottom portion 270 of second guide element 360. This intermediate result reflects a general completion of a vertical descent of first guide element 386 along the Z-axis orientation (as represented by directional arrow 1 in legend 399), and a small degree of lateral movement along the Y orientation (as represented by directional arrow 2 in legend 399). In another aspect, as shown in FIG. 8A, first guide element 386 achieves this position after front exterior portion 137 of printhead module 316 had descended within cavity 317 while remaining spaced apart (by a minimum distance, such as distance D2 in FIG. 2A) from a front interior portion 374 (and its protruding surface features 378, such as electrically conductive springs) of cavity 317 of carriage 312.

Because the printhead module 316 has generally traveled to a bottom portion of cavity 317 of carriage 312 without damaging the surface features 378 of front interior portion 374 of cavity 317 and/or without damaging the surface features 377 of front exterior portion 137 of printhead module 316, the printhead module 316 can be further maneuvered into a fully engaged position relative to front interior portion 374 of cavity 317 of carriage 312. Accordingly, from the position shown in FIG. 8A, a force F is applied onto contact portion 388 of printhead module 316 which causes a rotational movement (as represented by directional arrow R) of printhead module 316, as shown in FIG. 8B.

This general rotational movement of the printhead module 316 is facilitated by a corresponding arc-shaped rotational movement of first guide element 386 within the pocket of the curved recess portion 272, as represented by directional arrow 3 in legend 399. In one aspect, curved recess portion 272 of second guide element 360 enables movement of first guide element 386 (and printhead module 316 as a whole) in a +Y direction, which in turn enables datum features 139 of printhead module 316 to slide over flange 313 at bottom interior portion 319 of cavity 317 and drop into the gap 323 defined at corner 325 of cavity 317 of carriage 312, as shown in FIGS. 8A and 8B. In this arrangement, the flange 313 prevents relative movement of printhead module 316 in the −Y direction, thereby causing datum feature 139 and flange 313 to function together as pivot mechanism about which printhead module 316 rotates, as represented by directional arrow R. It will be understood that this rotational movement (R) includes both a translational component along the Y orientation and a vertical component along the Z orientation. Via application of force F, this rotational movement continues until the printhead module 316 reaches the position shown in FIG. 8B in which the front exterior portion 137 of printhead module 316 is fully engaged against front interior portion 374 of the cavity 317 of the carriage 312. In this fully engaged position, controller circuitry (e.g. controller circuitry 75 in FIG. 2A) of carriage 312 is in electrical contact and communication with controller circuitry (e.g. controller circuitry 64 in FIG. 2A) of printhead module 316.

Figure 9A:
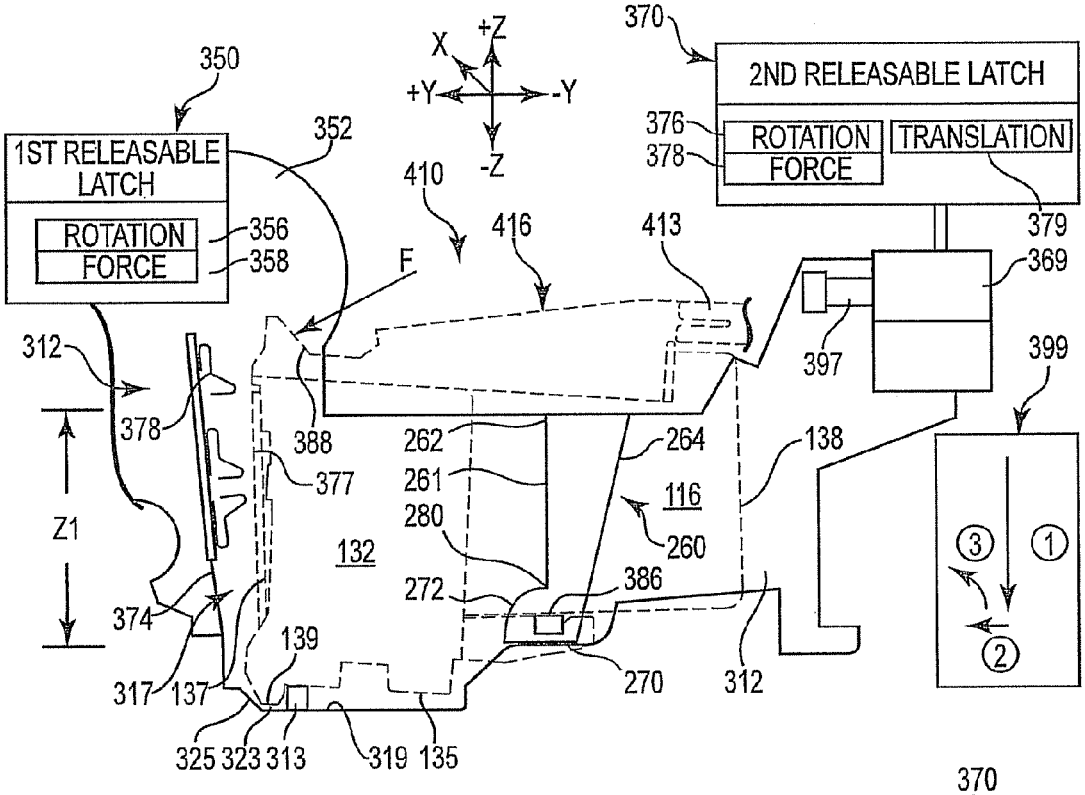
FIG. 9A is a front plan view schematically illustrating a printhead module in a first position during removable installation into a carriage, according to one example of the present disclosure.
Figure 9B:
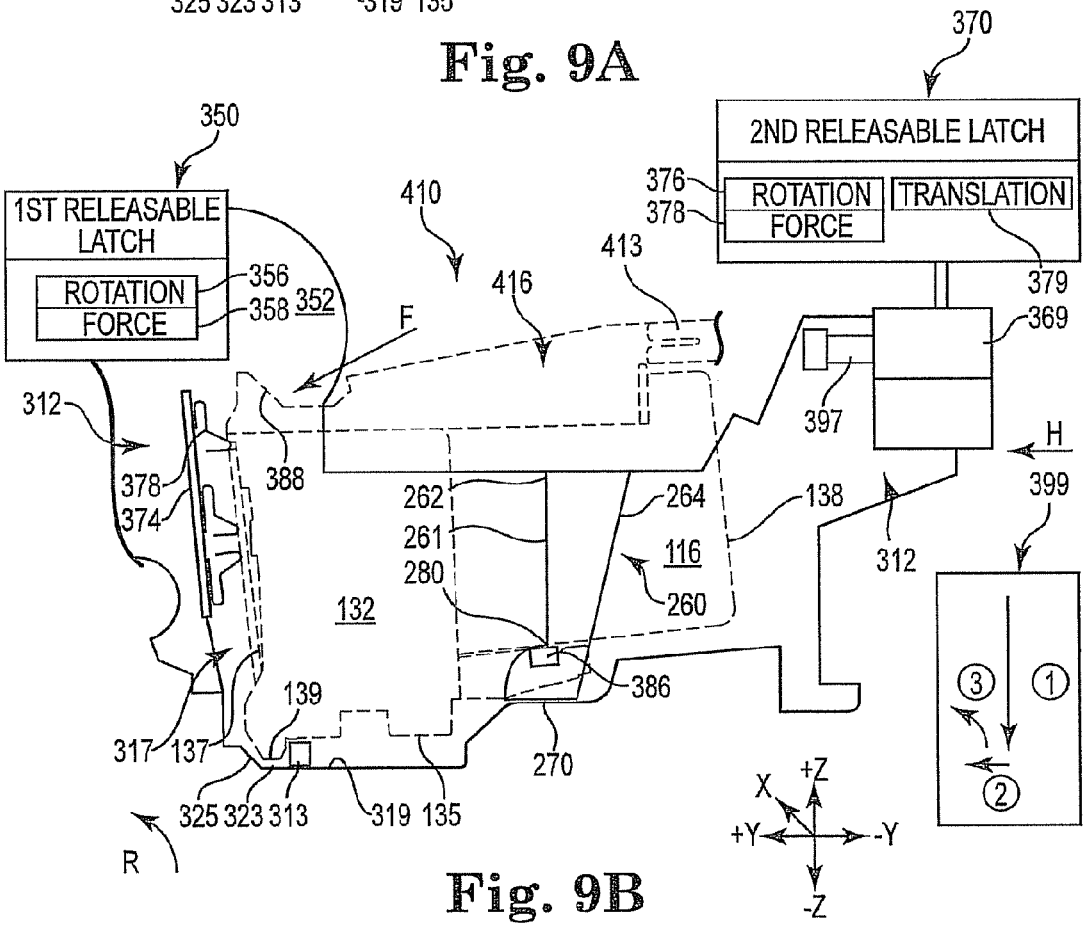
FIG. 9B is a front plan view schematically illustrating a printhead module in a second position during removable installation into a carriage, according to one example of the present disclosure.

FIGS. 9A-9B are side plan views schematically illustrating a printer system 410 in which a printhead module 416 is being removably installed into a carriage 312, according to one example of the present disclosure. The printer system 410 includes at least substantially the same features and attributes as printer system 310 (as previously described in association with FIGS. 8A-8B), except further including a first and second releasably latch mechanisms 350, 370 for securing the printhead module 416 into the cavity 317 of the carriage 312. Moreover, in printer system 410, printhead module 416 further includes an array 112 of needle couplings 113 (similar to those previously described in association with at least FIGS. 5A-5B) to engage ink supply ports for fluidly communicating with an off-axis ink supply (like off-axis ink supply 57 in FIG. 2B).

As shown in FIG. 9A, printer system 410 further includes a first releasable latch mechanism 350 positioned adjacent a front interior portion 374 of cavity 317 of carriage 312. In general terms, among other functions, the first releasably latch mechanism 350 acts to apply the force F against contact portion 388 of printhead module 416 that causes front exterior portion 137 of printhead module 416 to engage front interior portion 374 of cavity 317 of carriage 312. In one aspect, the first releasable latch mechanism 350 includes a rotation function 356 by which the first releasable latch mechanism 350 moves from a disengaged position to an engaged position to bear against contact portion 388 of printhead module 316. In the engaged position, latch mechanism 350 executes a force function 358 by which the force F is applied against the contact portion 388 of printhead module 316 until the front exterior portion 137 of the printhead module 316 fully engages the front interior portion 374 of the cavity 317 of the carriage 312, as shown in FIG. 9B.

As shown in FIGS. 9A-9B, the printer system 410 also includes a second releasable latch mechanism 370 by which ink supply ports 397 are brought into engagement against needle couplings 413 of printhead module 416. Like the first releasable latch mechanism 350, the second releasable latch mechanism 370 includes a rotation function 376. In addition, the second releasable latch mechanism 370 includes a translation function 379 by which the ink supply ports 397 are moved generally horizontally (as represented by directional arrow H in FIG. 9B) via coupling 369 to align the respective ink supply ports 397 with the needle couplings 413 before application of force function 378 that ultimately causes needle couplings 413 to penetratingly engage a septum of ink supply ports 397, which thereby establishes the fluid communication between the ink cartridges of printhead module 416 and an off-axis ink supply (like off-axis ink supply 57 in FIG. 2B) via ink supply ports 397.

At least some examples of a first guide element in the present disclosure enable printer systems to be modular in nature. By providing a first guide element that is replaceable and removably mounted relative to a carrier module, other components (e.g. the carrier module, the carriage, the ink cartridge) become modular elements which can be altered in their designs in some respects without necessarily dictating that the designs of the other components be altered to accommodate the changes in the other respective components. Moreover, in at least some examples, a first guide element (as removably mounted) on a carrier module acts to guide removable installation of the carrier module into a cavity of a carriage while protecting surface components of the carrier module and of a cavity of the carriage.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this present disclosure be limited only by the claims and the equivalents thereof.

What is claimed is:

1. A printer assembly including:

a carrier including a front exterior portion, side portions extending in a first orientation, and a mounting portion to receive an ink cartridge; and a first guide element removably mounted on the carrier and including protrusions extending outward beyond each side portion, and spaced apart from the front exterior portion along the first orientation, to slidably engage a guide structure of a carriage cavity to maintain a minimum spacing between the front exterior portion of the carrier and a front interior portion of the carriage cavity during at least a portion of removable insertion of the carrier into the carriage cavity.

2. The printer assembly of claim 1, wherein the front exterior portion of the carrier includes a first controller circuitry and the carrier comprises:

a printhead structure positioned on a bottom portion of the carrier, connected via electric communication pathways with the first controller circuitry, and connected via a fluid communication pathway to a fluid mounting portion of the carrier, at which an ink cartridge establishes fluid communication with the printhead structure.

3. The printer assembly of claim 1, comprising:

a carriage including a cavity having a front interior portion and spaced apart side walls that include the guide structure, wherein the guide structure includes a recess formed in each side wall of the carriage to slidably receive the first guide element, and wherein the front interior portion of the cavity includes a collapsible biasing mechanism to engage the front exterior portion of the carrier.

4. The printer assembly of claim 3, wherein the recess in each side wall of the carriage includes:

a generally straight front portion extending from an upper edge portion of the cavity to a terminal end, wherein the second distance extends from the front portion of the recess to the front interior portion of the cavity; and a curved portion extending from the terminal end of the front portion to define a second recess in a direction toward the front interior portion of the cavity, wherein the second recess includes a front portion spaced apart from the front interior portion of the cavity by a third distance less than the first distance to enable contact, and to establish an electrical communication pathway between, the front interior portion of the cavity and the front exterior portion of the carrier.

5. The printer assembly of claim 1, wherein the carrier includes a rear portion generally spaced apart along the first orientation from the front exterior portion, wherein the rear portion comprises:

an array of side-by-side mounting structures adjacent to the rear portion with each mounting structure positioned to receive at least a portion of an ink cartridge.

6. The printer assembly of claim 5, wherein the guide element includes:

an elongate spine; and a plurality of spaced apart fingers extending from the spine with each finger transverse relative to a longitudinal axis of the spine and with each finger positioned to be removably mounted within a recess of each of the mounting structures, wherein a top portion of each finger includes a mounting structure to removably mount a bottom portion of an ink cartridge, wherein the end portions of the first guide element are defined by opposite end portions of the spine and wherein each finger is sized and shaped to removably mount within a respective one of the mounting structures.

7. The printer assembly of claim 5, comprising each ink cartridge comprises an on-board pressure regulator and the ink cartridge is connectable to an externally located ink supply.

8. A printer assembly including:

a carrier including a front exterior portion, a rear portion, and side portions extending in a first orientation between the front exterior portion and the rear portion, the carrier further including an array of mounting structures extending generally parallel to the first orientation and positioned adjacent to the rear portion with each mounting structure positioned to receive at least a portion of an ink cartridge;

a guide structure including at least two portions with a respective one of the at least two portions removably mounted relative to each of the two outermost mounting structures to cause the at least two portions to protrude outward, transverse to the first orientation, beyond the two outermost mounting structures, wherein the guide structure is spaced apart from the front exterior portion by a first distance; and a carriage including a cavity having a front interior portion and spaced apart side walls that each define a first recess to slidably receive a respective one of the protruding portions of the guide structure, the first recess spaced apart from the front interior portion by a second distance no less than the first distance to maintain the front exterior portion of the carrier spaced apart from the front interior portion of the cavity during at least a portion of vertical movement of a first guide element within the first recess of each side wall.

9. The printer assembly of claim 8, wherein the guide structure comprises:

a plurality of spaced apart, generally parallel fingers with each finger mounted within a recess of each of the mounting structures, wherein a top portion of each finger includes a mounting structure to removably mount a bottom portion of an ink cartridge, and wherein each outwardly extending, protruding portion of the guide structure extends directly from a respective one of the two outermost, oppositely disposed fingers.

10. The printer assembly of claim 8, comprising:

a plurality of ink cartridges with each ink cartridge removably mounted onto the carrier and relative to a respective one of the mounting structures, wherein each ink cartridge includes a pressure regulator structure and a port for fluid communication with an ink supply external to the ink cartridge and carrier.

11. The printer assembly of claim 8, wherein the first recess in each side wall of the carriage includes:

a generally straight front portion extending from an upper edge portion of the cavity to a terminal end, wherein the second distance extends from the front portion of the first recess to the front interior portion of the cavity; and a curved portion extending away from the terminal end of the front portion of the first recess to define a second recess in a direction extending toward the front interior portion of the cavity, wherein the second recess includes a front portion spaced apart from the front interior portion of the cavity by a third distance less than the first distance to enable contact, and to establish an electrical communication pathway between the front interior portion of the cavity and the front exterior portion of the carrier.

12. The printer assembly of claim 8, wherein the front interior portion of the cavity of the carriage includes a first controller circuitry and the front exterior portion of the carrier includes at least a portion of a second controller circuitry, and wherein the carrier includes a bottom portion having a printhead structure connected via an electric communication pathway with the second controller circuitry and connected via a fluid communication pathway to a fluid mounting portion of the carrier, through which each respective ink cartridge establishes fluid communication with the printhead structure.

13. A method of manufacturing a printer assembly comprising:

forming a carrier including a front exterior portion and a rear portion spaced apart from the front exterior portion in a first orientation, and forming an array of mounting structures adjacent to the rear portion with each mounting structure positioned to receive at least a portion of an ink cartridge with two outer respective mounting structures defining opposite side portions of the carrier at the rear portion;

removably mounting first guide structures onto at least the two outer mounting structures to cause the first guide structures to protrude outward beyond a side portion of the carrier, the first guide structures spaced apart from the front exterior portion by a first distance; and forming a carriage including a cavity having a front interior portion and spaced apart side walls that each define a second guide structure to slidably receive a respective one of the first guide structures and forming the carriage includes positioning a front wall of the second guide structure to be spaced apart from the front interior portion of the carrier by a second distance no less than the first distance to maintain the front exterior portion of the carrier spaced apart from the front interior portion of the cavity during at least a portion of vertical movement of each first guide structure within a respective one of the second guide structures of the cavity of the carrier.

14. The method of claim 13, comprising:

placing at least a portion of a controller circuitry on the front exterior portion of the carrier;

placing a printhead structure on a bottom portion of the carrier, arranging electrical communication pathways from the printhead structure to the controller circuitry and arranging fluid communication pathways from the printhead structure to a fluid mounting portion of the carrier through which an ink cartridge fluidly communicates with the printhead structure.

15. The method of claim 13, wherein forming the carrier includes:

defining the second guide structure as a recess having a generally straight front portion, a curved recess portion, a bottom portion, and an angled rear portion, wherein the angled rear portion extends from an upper edge portion of the cavity to the bottom portion, wherein the front portion includes a terminal end at a third distance above the bottom wall, and wherein the recessed curved portion defines a transition between the terminal end of the front portion and the bottom portion.

* * * * *